US007436129B2

(12) United States Patent
Olson

(10) Patent No.: US 7,436,129 B2
(45) Date of Patent: Oct. 14, 2008

(54) TRIPLE-LOOP FLUORESCENT LAMP DRIVER

(75) Inventor: Scot Olson, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/695,216

(22) Filed: Apr. 2, 2007

(65) Prior Publication Data

US 2007/0164682 A1 Jul. 19, 2007

Related U.S. Application Data

(63) Continuation-in-part of application No. 10/788,895, filed on Feb. 27, 2004, now Pat. No. 7,312,780.

(51) Int. Cl.
*G05F 1/00* (2006.01)

(52) U.S. Cl. ..... 315/291; 315/307; 315/224; 315/274

(58) Field of Classification Search ..... 315/291, 315/307, 308–311, 224, 225, 247, 246, 274–289
See application file for complete search history.

(56) References Cited

U.S. PATENT DOCUMENTS 4,959,594 A 9/1990 Ruby
4,998,045 A 3/1991 Ruby
5,027,034 A 6/1991 Ruby et al.
5,612,593 A 3/1997 Olson
5,754,013 A 5/1998 Praiswater
5,894,394 A 4/1999 Baba et al.
6,118,415 A 9/2000 Olson
6,222,709 B1 4/2001 Baba
6,947,024 B2 9/2005 Lee et al.
2002/0121865 A1 * 9/2002 Nakatsuka et al. ..... 315/209 PZ

* cited by examiner

*Primary Examiner*—Tuyet Vo
(74) *Attorney, Agent, or Firm*—Ingrassia, Fisher & Lorenz, P.C.

(57) ABSTRACT

A driver circuit provides electrical energy from a power source to a fluorescent lamp such as that used in a flat-panel or other liquid crystal display (LCD). The circuit includes a transformer having a primary winding and a secondary winding, with the ends of the secondary winding coupled to the fluorescent lamp. A first switch switchably provides a drive output signal to the transformer based upon a switch input signal. A current control loop adjusts the switch input in response to the current in one of the windings of the transformer, and a luminance control loop adjusts the switch input in response to the brightness of the light. A lamp current frequency control loop adjusts the polarity of the primary winding in response to a signal received from the transformer to thereby adjust the frequency of the lamp drive current applied to the fluorescent lamp.

14 Claims, 3 Drawing Sheets

TRIPLE-LOOP FLUORESCENT LAMP DRIVER

CROSS-REFERENCES TO RELATED APPLICATIONS

This is a continuation-in-part of application Ser. No. 10/788,895 entitled "Fluorescent Lamp Driver System" filed Feb. 27, 2004 now U.S. Pat No. 7,312,780.

TECHNICAL FIELD

The present invention generally relates to optical displays, and more particularly relates to lamp drivers in optical displays.

BACKGROUND

Various types of optical displays are commonly used in a wide variety of applications including computer displays, televisions, cockpit avionics, night vision (NVIS) applications and the like. Included among these various types of optical displays are liquid crystal displays (LCDs) such as active matrix LCDs (AMLCDs). LCDs typically use a passive or active matrix display grid to form an image on the display surface. Such displays typically include any number of pixels on the display grid that are arrayed in front of a backlight. By controlling the light passing from the backlight through each pixel, color or monochrome images can be produced in a manner that is relatively efficient in terms of physical space and electrical power consumption.

Frequently, LCD backlights are implemented with fluorescent lamps or the like. A fluorescent lamp is any light source in which a fluorescent material transforms ultraviolet or other energy into visible light. Typically, a fluorescent lamp includes a glass tube that is filled with argon or other inert gas, along with mercury vapor or the like. When an electrical current is provided to the contents of the tube, the resulting arc causes the mercury gas within the tube to emit ultraviolet radiation, which in turn excites phosphors located inside the lamp wall to produce visible light. Fluorescent lamps have provided lighting for numerous home, business and industrial settings for many years.

Despite the widespread adoption of displays and other products that incorporate fluorescent light sources, however, designers continually aspire to improve the electrical efficiency of the light source, to extend the dimmable range of the light source, and/or to otherwise enhance the performance of the light source, as well as the overall performance of the display. In the avionics arena, in particular, there is a need to reduce power consumption while also improving the displayed image presented to the viewer across a wide range of luminance. Therefore, it is desirable to create an improved lamp driver system that provides a relatively wide luminance range and relatively precise brightness control while providing good electrical efficiency.

BRIEF SUMMARY

In various embodiments, a driver circuit provides electrical energy from a power source to a fluorescent lamp such as that used in a flat panel display, head-up display, liquid crystal display and/or the like. Power is provided to the lamp via a transformer with a primary and a secondary winding, with the ends of the secondary winding coupled to the fluorescent lamp. A high-side current steering circuit is configured to switchably provide a drive output coupling the power source to the transformer in response to a switch input. In various embodiments, a current control loop is configured to adjust the input to the high-side current steering circuit in response to the current in one of the windings of the transformer and/or a luminance control loop is configured to adjust the switch input in response to the brightness of the light. A lamp current frequency control loop may then be configured to adjust an electrical polarity of the primary winding to adjust the frequency of current applied to the lamp.

BRIEF DESCRIPTION OF THE DRAWINGS

The present invention will hereinafter be described in conjunction with the following drawing figures, wherein like numerals denote like elements.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

According to various exemplary embodiments, a lamp driver circuit with at least three resonant loops provides for highly efficient and effective lamp operation. A current control loop and a luminance control loop are provided, along with a separate lamp current frequency control loop that controls the frequency of electrical current applied to the lamp. This "frequency loop" obtains a trigger signal from the transformer coupled to the lamp, or from another source as appropriate. The trigger signal is then processed with suitable analog and/or digital circuitry to provide appropriate electrical signals coupled to each end of the primary transformer winding. By separating the polarity of the applied power from the current and luminance control loops, the frequency of the drive signal applied across the lamp can be increased or otherwise adjusted. These adjustments in frequency can improve the efficiency of the light source, reduce undesirable electromagnetic interference (EMI) emissions, and/or produce other benefits.

The term "coupled" in the context of this document refers to the direct or indirect connection of two devices or objects in a physical, logical, electrical or other appropriate sense. While devices "coupled" together may electrically communicate or otherwise interoperate with each other, they need not be physically joined together. In particular, two objects that are "coupled" together may have one or more intervening objects (e.g. electrical components such as resistors, capacitors, digital or analog filters and/or the like) between them and need not be in direct physical or electrical contact with each other.

Figure 1:
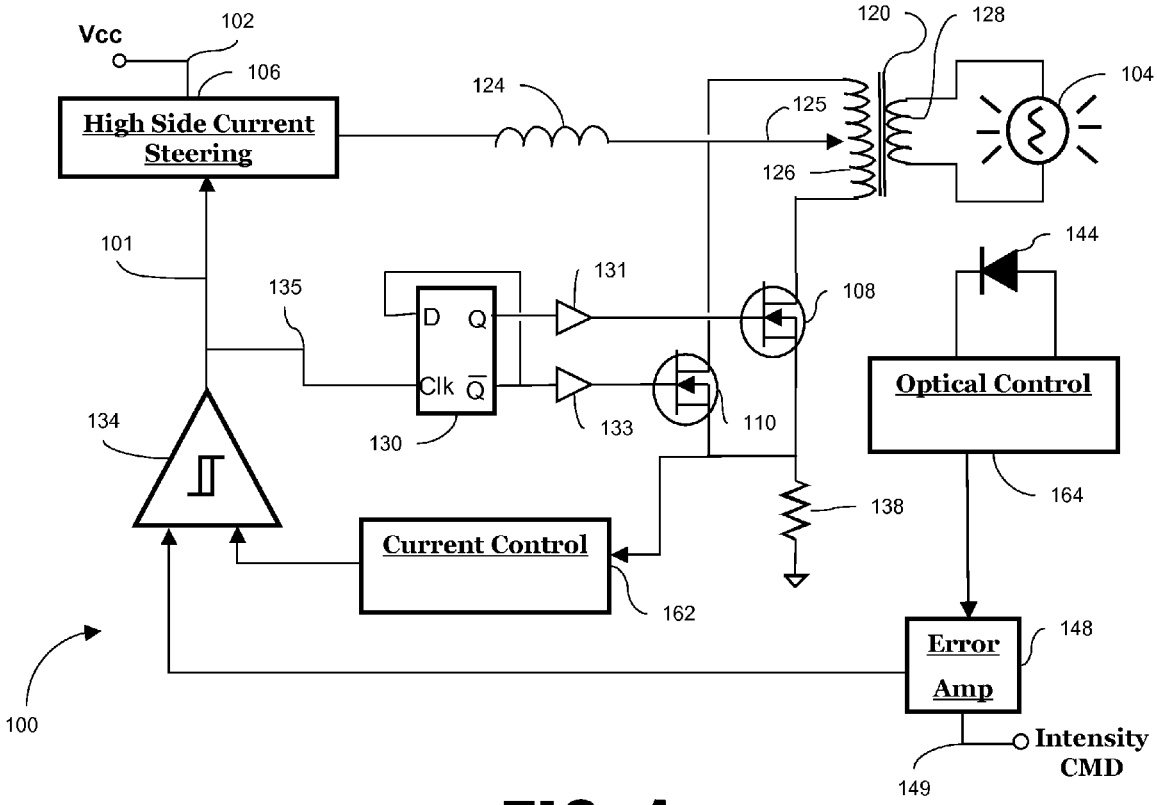
FIG. 1 is a block diagram of a dual-loop lamp control circuit.

Referring now to FIG. 1, an exemplary two-loop lamp drive circuit 100 suitably delivers energy to a plasma in a fluorescent lamp 104 in a resonant manner. The arrangement of circuitry shown in the figure has two fundamental control loops: a current control circuit 162, and an optical feedback circuit 164. Lamp driver 100 is appropriately designed to obtain input power from a regulated, filtered power source 102, such as a battery or other reference source. Various embodiments of drive circuit 100 may be able to regulate power delivered to lamp 104 from a widely ranging input supply, but for avionics applications that exhibit a large dimming ratio, better results may be achieved with a fairly tightly regulated input supply.

The main arc drive circuitry 100 suitably includes at least a current control circuit 162 and an optical feedback circuit 164 that control lamp current and lamp luminance, respectively. As shown in FIG. 1, in one embodiment an arc transformer 120 with a center-tapped primary winding 125 is fed current through the center tap by an inductor 124. Two switches (e.g. N-channel FETs or the like) 108, 110 drive the outer legs 112, 114 (respectively) of the primary winding 126 on the arc transformer 120 in an alternating fashion to provide an AC signal on the secondary winding 128. A "high side" current steering module 106 suitably provides drive current to transformer 120 via an inductor 124 and/or any other circuitry as appropriate. The arc transformer secondary winding 128 is coupled to the two end terminals of the fluorescent lamp 104 as appropriate. Since the power FETs 108 and 110 in the arc drive each carry relatively high levels of current in the embodiment shown, a high-current driver 131 and 133 on the gate of each switch quickly transitions the FET through the linear region as it is commanded between off and on states, optimizing efficiency of the drive system.

Source leads of the switches 108, 110 are shown connected together and through a current sense resistor 138 (e.g. a resistor of about 0.025-ohms or so) to signal return. Continuous current in sense resistor 138 is filtered and amplified in loop 162; this signal drives the positive input of a hysteretic comparator 134. The output of the hysteretic comparator in the FIG. 1 embodiment drives high side current steering circuit 106. This drive signal is shown in FIG. 1 as switch input signal 101, which may be filtered and/or otherwise adjusted by filter circuitry 105 as appropriate and desired for the particular embodiment.

The two N-channel FET drivers 108 and 110 are driven by signal 135, which in this embodiment is shown to coincide with drive signal 101. Signal 135 is provided as a clock input to a D flip-flop with latching output. D flip-flop operation ensures only one N-channel FET is on at any time. In operation, the rising (or trailing) edge of any pulse arriving on signal line 135 can shift the signal 137 provided at the data (D) input of the device. In practice, signal 137 is provided from the inverting output (/Q) of the same device, thereby providing that switched 108 and 110 should remain in opposite (i.e. activated or non-activated) states, and that the states of each switch 108, 110 should change on any rising edge of signal 135. As noted below, this same structure can receive an input 135 from other sources in circuit 100 to improve operation. Signal 135 can be obtained from the power switch 106, from inductor 124, from transformer 120 and/or for any other signal node existing between the voltage source 102 and lamp 104 as appropriate. Since flip-flop 130 in this embodiment is toggled by any rising voltage edge on signal 135, many equivalent input signals 135 could be provided. Additionally, flip-flop 130 could be equivalently replaced with a trailing edge flip-flop, with a conventional latch circuit, with discrete components configured to provide latching functions, and/or with any other logical or electrical equivalent as appropriate.

Current control loop 162 regulates the flow of current through the plasma in the fluorescent lamp for a particular luminance desired to be produced from the lamp. The desired luminance is provided by an input drive signal 149 that is received from an external control source as appropriate. High-side current steering, controlled by a hysteretic comparator 134, maintains the level of current for the given light output by periodically or aperiodically refreshing the current control source (e.g. transformer 120) with power from power supply 102. Low-side current steering, also driven from the hysteretic comparator 134 in FIG. 1, determines the path excitation current flows in the current control circuitry 120 and lamp interface, and the direction that current flows within the lamp. Lamp current frequency can range from about 10 kHz to 100 kHz or more in this embodiment, depending on lamp characteristics, current control and lamp interface elements, current-loop voltage amplifier gain, comparator hysteresis, luminance level and/or other factors as appropriate. Current, after flowing through the plasma in lamp 104, returns to the lamp interface and current control circuitry 120, finally arriving back to the filtered input power source 102 after being measured, filtered, and/or otherwise processed as appropriate by current control circuit 162 before being presented to an input of hysteretic comparator 134.

Generated light suitably exits the lamp at an angle that may be approximately normal to the outside glass surface. Some of this light impinges on a photodiode, photosensor and/or other photon-to-current converter 144 that is coupled to the arc drive circuitry via optical feedback circuit 164. The optical feedback circuit 164 obtains an electrical signal from photon to current converter (e.g. photodetecting diode 144) that measures the luminous flux coming from the lamp 104, and that outputs a proportional electrical current. This current can then be converted to a voltage and provided to an input of an error amplifier 148 to produce an optical amplifier that has relatively high gain at low luminance and exponentially decreasing gain at high luminance. The logarithmic amplifier 146 helps control stability in the optical control loop when higher levels of luminance and power are desired from the fluorescent lamp driver 100. The error amplifier 148 in turn drives an input to the hysteretic converter 134 described above. Luminance command signals 149 to lamp driver 100 may be obtained and processed as appropriate.

The positive input terminal of the error amplifier 148 is generally maintained at or near zero (or some other reference) potential. The output of error amplifier 148 can be compared with the output of the current control loop amplifier 132 at hysteretic converter 134 as appropriate. This hybrid control arrangement causes the current control loop circuitry 162 to drive plasma in the fluorescent lamp, thereby generating an intensity of fluorescent light corresponding to a signal out of the optical amplifier 146 that has the effect of negating luminance commanded signals 149. Hysteretic comparator 134 thus couples the current control loop 162 with the optical feedback loop 164, and it is the complex interplay between the two loops and the fluorescent lamp, which determine the physical processes occurring with plasma in the lamp channel.

The effects of current control loop 162 and luminance control loop 164 therefore combine to produce a resonant drive signal 125 to transformer 120, which in turn provides a drive signal to lamp 104 that is determined as a function of drive signal 125 and the polarity of winding 126, which in turn is determined by the conducting or non-conducting states of switches 108 and 110. In the embodiment shown in FIG. 1, the polarity of the voltage on winding 126 and the drive signal 125 are both determined in response to a common signal, since the input signal 135 used to toggle flip-flop 130 is effectively the same signal used to control the applied voltage at switch 106. In various embodiments, however, these two signals can be separated so that changes in polarity of the voltage on winding 126 are not directly related to the application of the drive signal. Stated another way, the polarity of the voltage across winding 126 can be adjusted at a different rate than the rate at which the drive signal 125 is changed.

Figure 2:
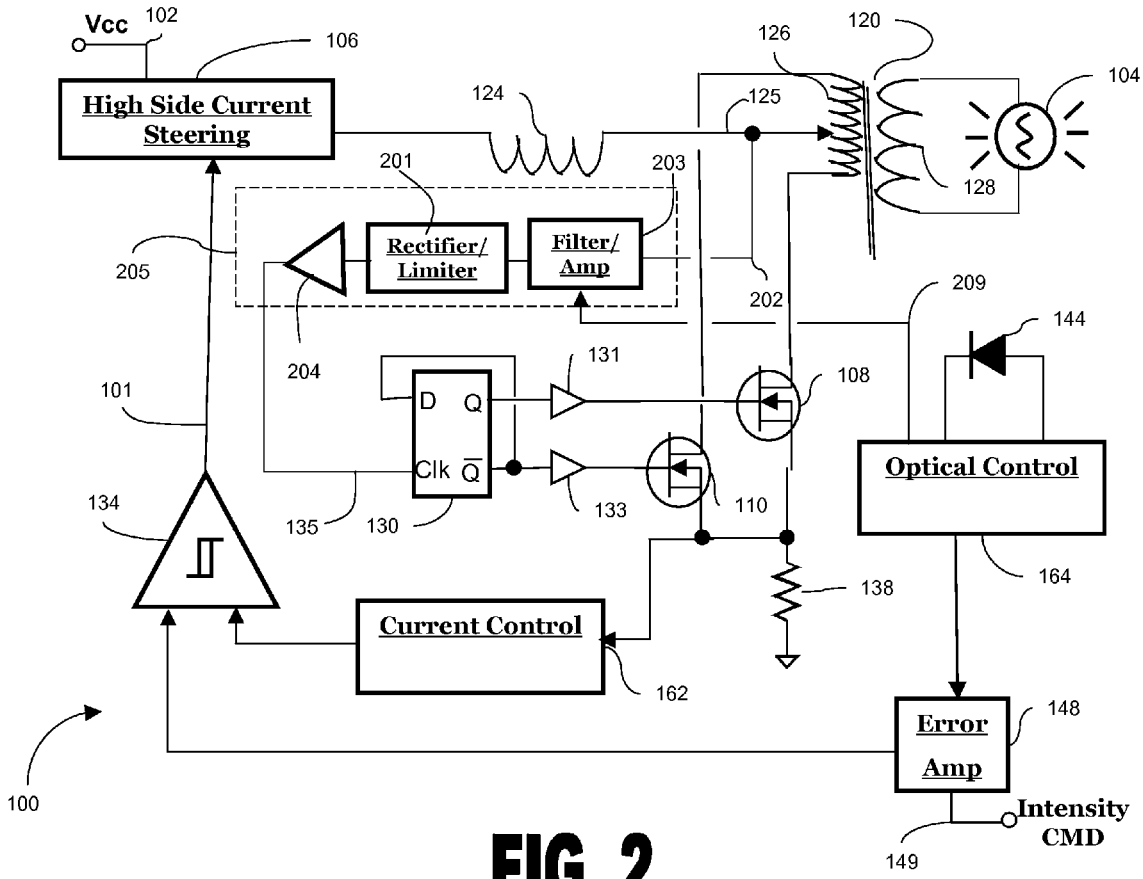
FIG. 2 is a block diagram of one embodiment of a triple-loop lamp control circuit.
Figure 3:
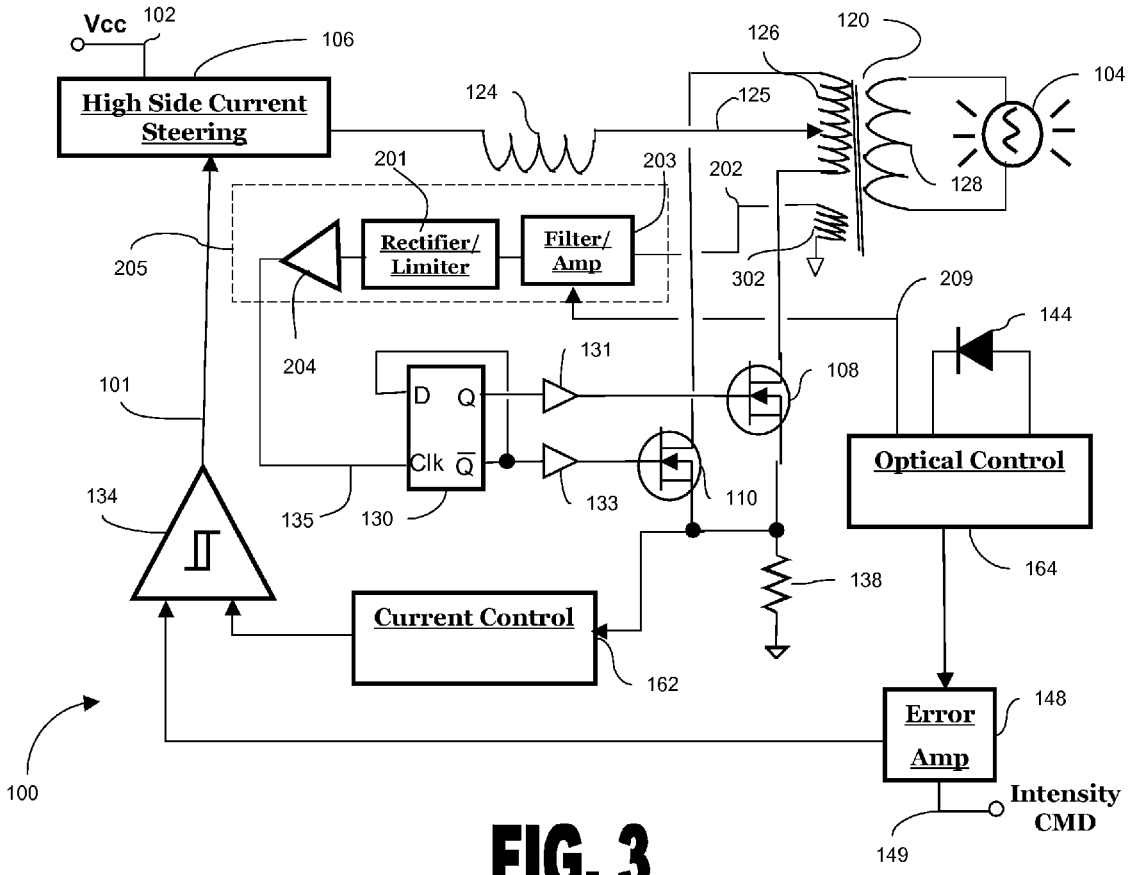
FIG. 3 is a block diagram of an alternate embodiment of a triple-loop lamp control circuit.

FIGS. 2 and 3, for example, show two circuits and techniques whereby the polarity of the voltage across winding 126 is toggled in response to the conditions within the lamp reflected back through transformer 120 to the primary side, rather than from the input to switch 106. This can be obtained by, for example, obtaining the input 135 to flip-flop 130 from an electrical node located between the output of high-side current steering module 106 and transformer 120. Moreover, because electrical effects of lamp 104 are reflected in signals propagating across transformer 120, obtaining the input to a low-side current control from the transformer 120 or signals coupled thereto can have the effect of adjusting the frequency of electrical current applied to the lamp in response to lamp operation.

FIG. 2, for example, shows that a signal 202 obtained from the primary side of transformer 120 can be rectified, filtered, amplified and/or otherwise processed to produce a suitable input signal 135 to flip-flop 130. In this embodiment, drive signal 125 applied to the center tap of primary winding 126 is also applied (as signal 202) to filter circuitry 203 as appropriate in a separate lamp current frequency control loop 205. Effects of lamp operation are coupled to drive signal 125 through transformer 120, thereby allowing signal 125 to additionally drive the current frequency control applied to lamp 104. Loop 205 as shown in FIG. 2 includes a rectifier/limiter 201, filter/amplifier 203 and amplifier 204. In other embodiments, rectifier 201 and/or amplifier 204 may be omitted or combined within filter 203.

Filter 203 processes the received signal 202 by applying any suitable delay or other filter to produce an output with desired timing characteristics. Filter 203 may also incorporate a low or band pass filter to remove high-frequency noise from (at least) the edges of the input signal to produce an output signal 135 having a desired waveform and frequency. In various embodiments, filter 203 is an active filter that adjusts the frequency of signals 135 in response to the intensity of light produced by lamp 104; this may be accomplished by adjusting filter 203 in response to an output 209 from optical control circuit 164 or error amplifier 148. In other embodiments, however, filter 203 is a more passive filter that does not obtain input from the light intensity loop, and signal 209 is omitted. Filter 203 may also incorporate an amplifier (e.g. one or more operational amplifiers) to amplify and/or attenuate input signals 202 as appropriate.

Rectifier/limiter 201 is any circuit or the like capable of further shaping signals 202. Signals 202 may be rectified using a conventional diode rectifier, for example. The rectified signals may be further limited at any appropriate voltage to prevent overloading of amplifier 204 or other circuitry. In various equivalent embodiments, rectifier circuit 201 is eliminated, placed in front of filter 203, incorporated within filter 203 and/or otherwise located within loop 205.

Amplifier 204 is provided in any appropriate manner; in various embodiments, amplifier 204 is effectively a digital amplifier that provides a high or low reference (e.g. "rail") voltage at the output in response to input signals. This digital-type output can be useful in providing a sharp clock signal to flip-flop 130 in some embodiments. Alternatively, filter 203 could incorporate any sort of analog amplifier as appropriate to equivalently encompass the function of amplifier 204.

In many embodiments, it may be desirable to toggle the polarity of winding 126 at a rate that is relatively fast with respect to the rate at which signal 125 changes. This rate can be determined using conventional RC filter design techniques. Moreover, conventional low, band and/or high-pass filtering techniques using RC or other analog filtering components can be used to shape the edges of signal 202 as desired. In alternate embodiments, digital sampling and filtering techniques can be used. One or more amplifiers 104 (which may be an op amp or other amplification module) can also be provided to amplify and/or attenuate signals 202 so that they produce signals of 135 with appropriate magnitude for flip-flop 130. As noted above, the signals 135 are generally provided to the "clock" input of flip-flop 130, which suitably responds to rising and/or falling edges of signals 135 to toggle the outputs provided at the "Q" and "/Q" terminals of the device.

FIG. 3 shows an equivalent embodiment that contains a drive signal loop 205 that obtains a signal input 202 from an auxiliary winding 302 associated with transformer 120. This auxiliary winding 302 may be wrapped around the core of transformer 120 on either the primary or secondary side of the device. In various embodiments, auxiliary winding 302 is wrapped around the primary side core of transformer 120 and contains enough windings to produce input signals 202 to drive control loop 205 as described above. The number of windings in winding 302 can be selected to produce output signals 135 with appropriate magnitude; alternately and/or additionally, the signals 202 obtained from winding 302 can be amplified or attenuated by amplifier 204 as appropriate.

Various embodiments of loop driver circuitry 100 therefore provide a drive control loop 205 that operates at a different rate from the signal 101 produced by current loop 162 and/or optical control loop 164. Because the polarity of the voltage applied across winding 126 can be separated from the drive signal 125 itself in this manner, high frequency AC drive signals can be applied to lamp 104, and/or performance of circuit 100 may be improved as appropriate. This adjustment in AC frequency may also be used to avoid undesirable RF emissions at particular frequencies (e.g. at a frequency that interferes with another component in a display system), or for any other purpose.

The concepts set forth above are generally referenced in the context of a "triple loop" driver circuit having a current control loop, a light intensity control loop and a drive control loop for ease of understanding. In practice, however, the concepts of a drive control loop may be implemented distinct from the current control and/or light intensity loops across a wide variety of alternate, yet equivalent, embodiments.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Various changes may be made in the function and arrangement of elements described in the exemplary embodiments without departing from the scope of the invention as set forth in the appended claims and their legal equivalents.

What is claimed is:

1. A driver circuit for providing a lamp drive current from a power source to a fluorescent lamp producing a light having a brightness, the circuit comprising:

a transformer having a primary winding and a secondary winding, wherein each of the primary and secondary windings have a first and a second end and are configured to conduct an electrical current having a polarity, and wherein the ends of the secondary winding are coupled to provide the lamp drive current to the fluorescent lamp;

a current steering module configured to provide a drive output from the power source to the transformer in response to a current steering input;

a current control loop configured to adjust the current steering input in response to the current in one of the windings of the transformer;

a luminance control loop configured to adjust the current steering input in response to the brightness of the light; and a lamp frequency control loop configured to adjust the polarity of the electrical current in the primary winding in response to a signal received from the transformer to thereby adjust the frequency of the lamp drive current applied to the fluorescent lamp.

2. The driver circuit of claim 1 wherein the lamp frequency control loop comprises a filter circuit configured to filter the signal received from the transformer.

3. The driver circuit of claim 2 wherein the filter circuit is configured to adjust the frequency of the signal received from the transformer.

4. The driver circuit of claim 2 wherein the filter circuit is configured to shape the signal received from the transformer.

5. The driver circuit of claim 2 wherein the filter circuit comprises a digital amplifier.

6. The driver circuit of claim 1 wherein the lamp frequency control loop comprises:

a flip-flop having a clock input, a signal input, an inverting output, and a non-inverting output, and wherein the inverting input is coupled to the signal input;

a first switch coupled to the inverting input, to a reference voltage, and to the first end of the primary winding; and a second switch coupled to the non-inverting input, to the reference voltage, and to the second end of the primary winding;

wherein the polarity of the primary winding is adjusted by toggling the first and second switches to thereby switchably couple the first and second ends of the primary winding, respectively, to the reference voltage.

7. The driver circuit of claim 6 wherein the drive output is coupled to the clock input of the flip-flop.

8. The driver circuit of claim 6 wherein the flip-flop is a latching flip-flop.

9. The driver circuit of claim 6 wherein the first and second switches are transistors.

10. The driver circuit of claim 6 wherein the transformer further comprises a center tap on the primary winding that is coupled to the drive output of the current steering module.

11. The driver circuit of claim 10 wherein the center tap of the primary winding is coupled to the clock input of the flip-flop to form the lamp frequency control loop.

12. The driver circuit of claim 11 wherein the lamp frequency control loop comprises a filter circuit electrically disposed between the center tap of the primary winding and the clock input, wherein the filter circuit is configured to filter the drive output.

13. The driver circuit of claim 6 wherein the transformer comprises an auxiliary winding having an end coupled to the clock input of the flip-flop to form the lamp frequency control loop.

14. The driver circuit of claim 13 wherein the drive control loop comprises a filter circuit electrically disposed between the auxiliary winding and the clock input, wherein the filter circuit is configured to filter the drive output.

* * * * *